United States Patent [19]

Parrock, Sr.

[11] 4,238,942

[45] Dec. 16, 1980

[54] DIRECT DIAL COMBINATION LOCK WITH DRIVER-CAMMED RECIPROCATING TUMBLERS AND SCRAMBLED COMBS

[75] Inventor: Joseph J. Parrock, Sr., Milford, Ohio

[73] Assignee: The Mosler Safe Company, Hamilton, Ohio

[21] Appl. No.: 14,351

[22] Filed: Feb. 23, 1979

[51] Int. Cl.[3] ..... E05B 37/00

[52] U.S. Cl. ..... 70/299; 70/311; 70/316

[58] Field of Search ..... 70/133, 299, 311, 315–318, 70/321, 323, 327, 329

[56] References Cited

U.S. PATENT DOCUMENTS

| | | | |
|---|---|---|---|
| 2,775,115 | 12/1956 | Bremer | 70/133 |
| 3,436,941 | 4/1969 | Potzick | 70/311 |
| 3,518,856 | 7/1970 | Potzick | 70/299 |
| 3,719,064 | 3/1973 | Potzick | 70/299 |
| 3,981,167 | 9/1976 | Phillips | 70/311 |

*Primary Examiner*—Robert L. Wolfe

*Attorney, Agent, or Firm*—Wood, Herron & Evans

[57] ABSTRACT

A direct dial combination lock having tumblers which are cammed in reciprocating movement by rotation of a driver and which, once set, are disengaged by shifting the driver axially. Each tumbler has an internal cam track that is operated on by rotation of the driver to establish a reciprocating or back and forth tumbler motion. Gates presented on the respective tumblers receive individual combs that are movable as a set toward the tumblers in a direction perpendicular to the direction of tumbler back and forth movement. The combs are scrambled for greater manipulation resistance, and their positions relative to one another are changeable without opening the lock, to change the combination.

25 Claims, 18 Drawing Figures

Figure 1:
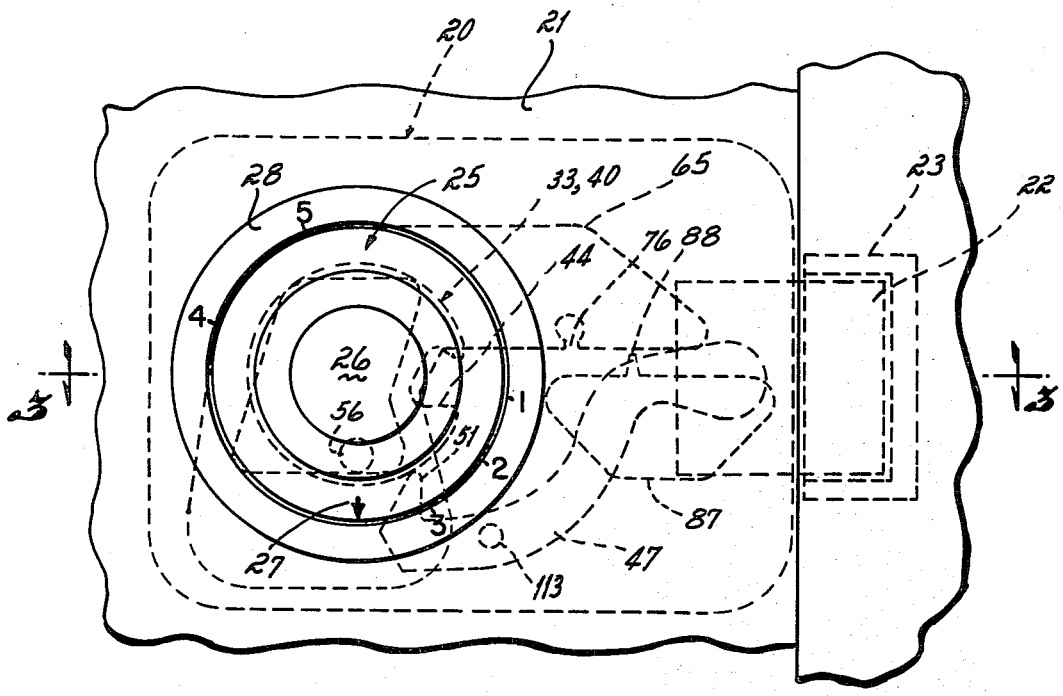

DIRECT DIAL COMBINATION LOCK WITH DRIVER-CAMMED RECIPROCATING TUMBLERS AND SCRAMBLED COMBS

This invention relates to a combination lock of the so-called "direct dial" type wherein the combination is run by turning the dial to a given angular position and then "setting" that dial position into the lock by shifting the dial axially so that an associated tumbler is disengaged and will remain in position during setting of other tumblers.

BACKGROUND

Combination locks of the direct dial type are known to the art, and are useful because of the relative simplicity of their operation. Ordinary combination locks (not of the direct dial type) must be operated by turning the dial a specified number of turns in a first direction, say four turns to the right, before stopping at the first number (or letter) of the combination, then a series of turns one less in number in the opposite direction, e.g., three turns to the left, to the next number of the combination, followed by a decreasing sequence of turns in opposite directions to set the other numbers into the lock and thereby position the tumblers.

As a practical matter, the operation of such locks is undesirably complex because of the need to remember and execute properly not only the combination itself, but also the dialing program, including both the number and direction of turns required before stopping at each number of the combination. Because of this complexity, locks with combinations of more than four numbers are rarely used, and such locks are relatively slow to set and require careful attention. Increasing complexity of the program with longer combinations puts a practical limit on the number of theoretically possible combinations. Moreover, locks having only three or four tumblers are more readily attackable by radiographic means than locks having a larger number of tumblers.

Direct dial locks are easier to operate because they require no complex program of dial turning. They can be operated by turning the dial directly to each combination number, and do not require opposite rotations of the dial between successive numbers. Moreover, such locks do not require any predetermined number of turns, or indeed, any turns of the dial between succeeding numbers of the combinations.

When the dial of a direct dial lock has been turned to a given number, that number is set into the lock by axial movement of an operating shaft (which may be the dial shaft itself), for example by pushing the dial inwardly a short distance. Absent any requirement of complex dial turning, it is thus practicable to use combinations of large sets of numbers, up to seven or more, and corresponding numbers of tumblers. This provides great resistance to surreptitious attack.

THE PRIOR ART

Bremer U.S. Pat. No. 2,775,115, titled "Manipulation-Resistant Combination Lock," issued Dec. 25, 1956 to the assignee of this application, recognizes that the noise and "feel" of a fence on the bolt operating lever, when it contacts a tumbler periphery as the dial is turned, can provide a basis for surreptitious attack. In that lock, such contact is prevented during tumbler setting by providing a driver with a cylindrical disk on which the lever nose (or lug) rides as the driver is rotated. Wheel-type tumblers are positioned rotationally by a drive pin extending from the driver which engages them sequentially through tumbler-to-tumbler lost motion couplings. When the tumblers have sequentially been positioned, the driver pin is disengaged from them by shifting the driver axially. As this is done the lever nose drops off the periphery of the driver cylindrical disk, toward the driver notch. If any tumblers are scrambled, the fence will strike the peripheries of such tumblers abruptly and cannot seat in the gate, nor can the lever nose engage in the driver notch. Although the Bremer lock provides improved manipulation resistance by holding the fence away from the tumblers as they are set and releases it only abruptly by the driver axial motion, it is not a direct dial lock in that the wheel-type tumblers must be positioned by a sequence of alternating turns in opposite directions.

Potzick U.S. Pat. No. 3,436,941, titled "Combination Lock with Cam-Operated Tumblers and Sequentially Engageable Tumbler Stops," and issued Apr. 8, 1969 to the assignee of this application, is directed to a true direct dial combination lock. In the peferred embodiment of the lock to which that patent is directed, the operating shaft turns a rotary cam which swings a series of lever tumblers. Each tumbler is pivoted for swinging movement relative to the cam axis, and is spring biased toward the cam. Each tumbler has a gate at its free end. Rotation of the cam positions the gates; the gates must be positioned according to the proper combination before they will receive with a series of fingers or teeth that are mounted to and move with the bolt, in order for the bolt to be retracted. The tumblers move with the cam when they are riding on it, but they can be prevented from following the entire movement of the cam, so as to follow the cam movement only to a certain point, by a series of stops with which the tumblers individually coact. Each stop is a lever which is spring loaded toward its respective lever tumbler and follows the cammed movement of the lever tumbler until the stop is locked in position by moving the lock dial shaft axially. The stops determine the positions of the gates when the lever tumblers are disengaged from the cam. Locking of the stops is accomplished sequentially by a stop holder which is advanced lineally by a ratchet and pawl mechanism actuated by axial shaft motion. The ratchet and pawl mechanism is releasable by moving the shaft in the opposite axial direction. The lock dial shaft is urged toward a centered axial position by opposed spring loaded plungers which bear on a plate attached to the shaft. Shaft movement in either axial direction from the centered position is permitted only at precise whole number dial settings by pins which block the plate connected to the shaft, unless the plate is in such position that narrow openings in it are aligned to receive the respective pins.

In U.S. Pat. No. 3,436,941, the fingers or teeth which determine the combination are connected to the bolt, and move with it as the bolt is withdrawn or extended. The fingers are releasably clamped to the bolt by a screw which can be loosened by a screw-driver so that the fingers can be moved relative to one another and to the bolt, to change the combination. Means are provided for disconnecting the bolt from the lock operating means when the fingers are released from their fixed position. An extra or supplemental axial movement of the operating shaft is required before the lock mechanism is conditioned to permit the bolt to be withdrawn.

Potzick U.S. Pat. No. 3,518,856, titled "Combination Lock With Cam Follower Positioned, Cumulatively Arrested Tumbler Elements" issued July 7, 1970 to the assignee of this application, is directed to a "second generation" form of direct dial combination lock. In the preferred embodiment of the lock to which that patent is directed, the operating shaft turns a set of several disk-like cams. One end of a pivoted cam follower is spring urged into contact with the shaped periphery of each respective cam. The other end of each cam follower bears upon and cams a lineally movable tumbler element. The slider tumbler is spring urged against the cam follower and is positioned in accordance with the angular position of the shaft. At the start of running of the combination, rotation of the dial operates all of the cam followers and slider tumblers, and as the combination numbers are dialed and set by axial movement of the shaft, the respective sliders are cumulatively arrested by tumbler holding means in the form of a slider holding pin which passes perpendicularly through a hole in the slider. The slider holding pin is mounted to and moves lineally with a ratchet. The ratchet responds to axial movement of the shaft through a flapper or lever which is swung by the shaft movement. A series of fence members, interfittable with the slider tumblers if the latter are properly positioned, are mounted for movement toward and away from the slider tumblers. The fence is not rigidly connected to the bolt or to the bolt lever, but responds through an off center sliding coupling to movement of the lever.

Potzick U.S. Pat. No. 3,719,064, titled "Combination Lock with Lineally Movable Cam Followers and Nonsequentially Acting Tumbler Holders", issued Mar. 6, 1973 to the assignee of this application, is directed to a "third generation" form of direct dial lock. In the preferred form of the lock of that patent, cam means on an operating shaft operate cam followers which are mounted for lineal movement toward and away from the shaft. A spring biases each follower toward the cam means. A tumbler is yieldably coupled to the respective cam follower by a coupling spring, and is mounted for lineal movement parallel to the follower. Each follower and tumbler has two oppositely facing surfaces which are perpendicular to the direction of follower movement. The coupling spring is seated between the oppositely facing surfaces of the follower and tumbler, and at all times abuts at least two of the surfaces which are opposed. The coupling spring reacts at one or the other end on the tumbler to bias it to follow the follower assembly and movement of the tumbler is prevented. A tumbler holder is movable transversely to each tumbler in the plane of movement of the latter, and is interengageable with its respective tumbler for holding it at a given position. Each holder is operated by a separate holder cam acting on an actuating spring between it and the holder. Either the tumbler or the holder has a projection on it which is seatable in any of a series of corresponding notches on the other, to hold the tumbler in a discrete position corresponding to a whole number dial position. The fences are contained in a fence housing, in which they overlie one another in the form of a deck. Movement of the fence unit toward the tumblers to engage if the tumblers are set in the proper position is prevented until all of the tumblers have been set. The fence unit is held in a remote position by the bolt lever, which engages a pin that projects from the fence pack. The lever is in turn positioned by a lever cam which is rotated by a stepping mechanism, responsive to axial movement of the dial shaft, and which holds the lever in remote position so that the fence pack is prevented from moving until the lever cam has been properly positioned.

The fences are ordinarily clamped in fixed positions inside their housing, but when unclamped can slide relative to one another in the housing to change the combination. The fence clamping means comprises a clamping spring and an element which is slidable with respect to the spring between a clamping position in which the element stresses the spring to clamp the fences against movement, and an unclamped position to which the element can be shifted so that stress on the spring is released, to permit fence movement. A key is engageable with the element for sliding it between the clamped and unclamped positions, the key having a bit which is insertable and removable through an aperture in the lock case only when the bolt has been retracted.

The three Potzick locks just described provide an unusually high degree of manipulation resistance, because in each of them the elements with which the tumbler gates must be aligned are themselves "scrambled", i.e., misaligned or staggered with respect to one another. For such locks to be analyzed radio-graphically, it is necessary not only to determine the positions of the tumbler gates, but also to determine the positions of the scrambled elementes with which the gates must be aligned. This "double scrambling" is much more difficult to analyze than the single scrambling (tumbler gates only) that is presented where a conventional "straight bar" fence interfits with the gates, as in the Bremer patent.

However, the lock structures of the three Potzick patents are very complicated. As a result those locks are quite difficult and critical to manufacture and assemble properly. For all their manipulation resistance and simplicity of operation, they are far too expensive for use in any but the most vital installations.

Phillips U.S. Pat. No. 3,981,167 titled "Direct-Dial Combination Lock", issued Sept. 21, 1976, shows a direct dial lock of the conventional gated tumbler wheel type with a conventional straight bar fence. In that lock, a pin on the drive is engaged with and is successively releasable from drive apertures in the tumbler wheels to allow sequential release of the located tumbler wheels upon axial movement of the driver. As in Bremer, the driver has a smooth cylindrical surface on which the lever nose rides that prevents engagement of the fence bar with the gate openings until the driver has been shifted axially to a tumbler wheel release location which aligns the lever nose with a driver notch.

Like Bremer, the Phillips lock is much simpler than the complex Potzick structures. However, because it requires gated tumbler wheels that receive a straight or "unscrambled" fence bar, it is more susceptible to attack. All of the tumblers align at a single position of the fence; and it is far easier to determine that one position that it is to determine the multiple alignment positions of the doubly scrambled Potzick locks.

BRIEF DESCRIPTION OF PRESENT INVENTION

The lock of this invention provides the manipulation resistance of double scrambling, but in a less complex structure which is less expensive to produce than the Potzick locks. At the same time it provides direct dial operation with much greater manipulation resistance than is afforded by straight bar fence of the type shown in the Bremer and Phillips patents. For the first time, a practical, simple direct dial lock has been provided in which both the tumbler gates and the element with which the gates must be aligned, are scrambled. This is achieved by a new structure wherein the tumblers are directly cammed in essentially linear or back and forth motion by a rotary driver cam. The driver cam engages each tumbler through a cam track formed as an internal aperture in the tumbler. Unlike the Potzick patents, no springs or biasing means are necessary to cause the tumblers to follow the cyclical motion of the driver cam. Unlike the Bremer and Phillips patents, the tumblers move back and forth, rather than rotationally.

Preferably, the cam of the driver is only intermittently engageable with the tumbler cam track as the driver is rotated through a complete revolution. At certain angular positions of the dial the cam does not ride on the cam track and does not cam the tumbler; the shape of the cam surface establishes a degree of lost motion between the driver rotation and tumbler cammed movement. The irregular operation confuses radiographic analysis, and it also facilitates reengagement of the driver cam with the tumblers after disengagement.

In the preferred embodiment of the invention, the lock includes several tumblers each in the form of a flat plate having an internal aperture the edge of which defines the cam surface. This aperture is engageable by a cam in the form of an off-center pin connected to the driver for rotation with it. The tumbler is mounted for linear movement in a plane perpendicular to the axis of driver rotation. The tumbler presents a gate on a projecting arm; the position of the gate shifts lineally, in the direction parallel to the bolt movement, as the tumbler moves.

In preferred form, the tumbler cam track has the shape of a slanted letter "B". Unlike the Potzick locks, the tumblers are not biased; the elimination of springs simplifies construction and improves reliability. Although the driver cam engages the tumbler cam surface only intermittently as the driver is rotated, so long as the driver is rotated in the same direction, the dial rotational position does correspond to a predetermined tumbler gate position. However, unlike previous locks of which I am aware, the dial positions at which the tumbler gates are uniformly spaced from one another are not themselves equiangularly spaced apart. So far as I know this is the first lock in which the dial index numbers are not uniformly spaced around the dial but rather are irregularly spaced.

The tumblers coact with teeth on a set of combs, to receive the respective teeth when the tumblers are properly aligned. The comb set is separate from the bolt lever, unlike conventional bar fences. The set is mounted for linear movement in the direction perpendicular to the direction of tumbler movement and perpendicular to the bolt motion. The individual combs are staggered or misaligned with respect to each other. The positions of the combs relative to one another can be changed in order to change the combination.

The driver is shiftable axially and, after a given tumbler has been set at a desired linear position, the driver is shifted axially to disengage its cam from the tumbler cam track and thereafter leave the tumbler in its then position. The driver has a cylindrical surface and, while it is in axial position for setting one or more of the tumblers, the nose or dog of the lever rides on the driver surface. This prevents engagement of the lever nose with the driver notch during tumbler setting. The nose can engage the driver notch only after all of the tumblers have been positioned.

Only the radial component of lever motion as its nose moves toward the driver notch is transmitted to the comb set; the combs are isolated from the lever movement as it withdraws the bolt. The radial (notch-engaging) component of lever movement is transmitted to the comb set through a coupling from the lever, so that the combs are shifted toward engagement with the gates and will be received in them if the gates are properly aligned. The lever decouples from the comb set as the bolt is withdrawn, so that neither the tumblers nor the combs follow such movement.

Figure 2:
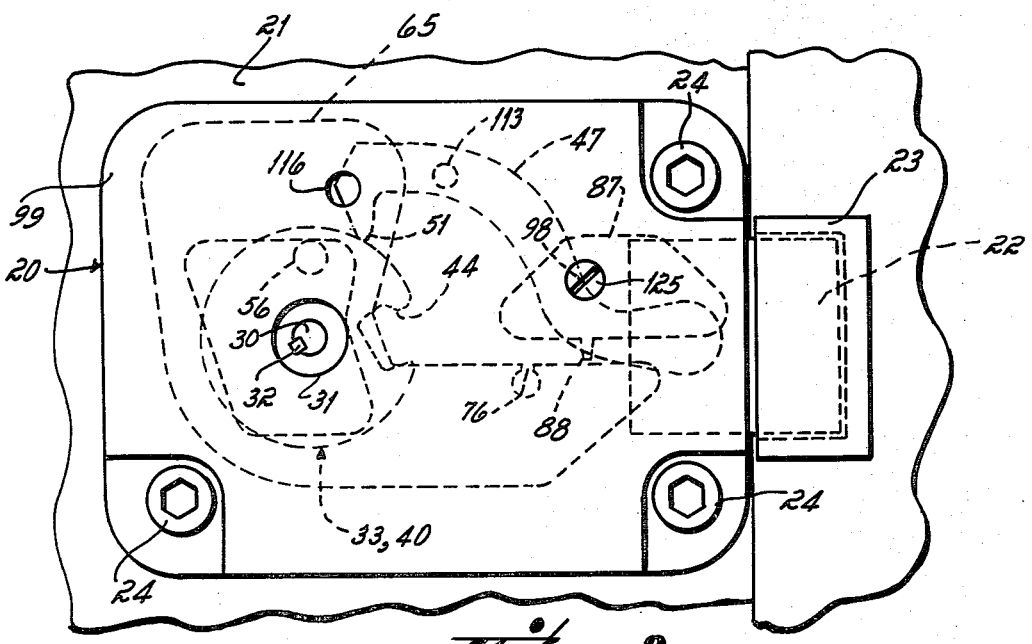
Figure 3:
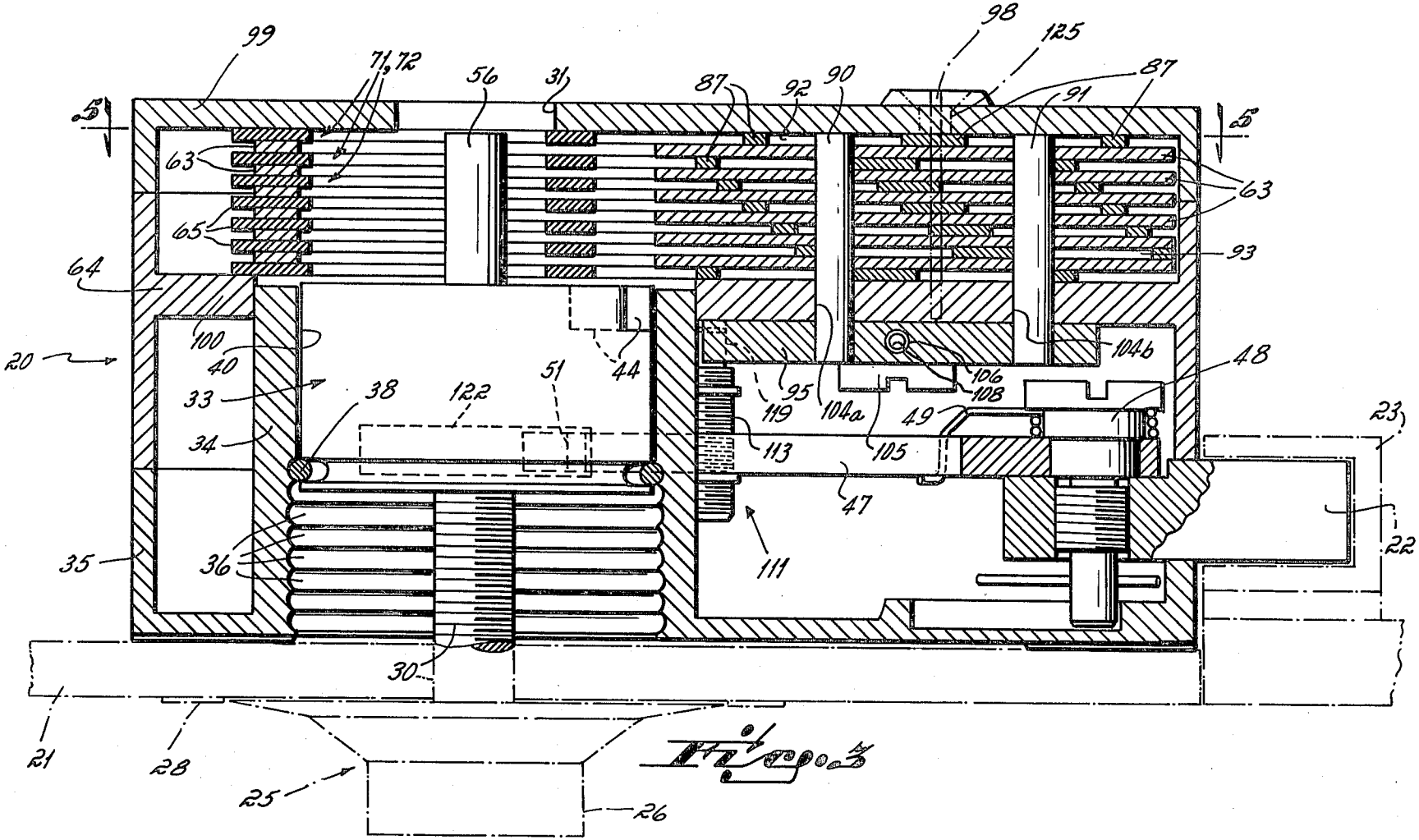
Figure 4:
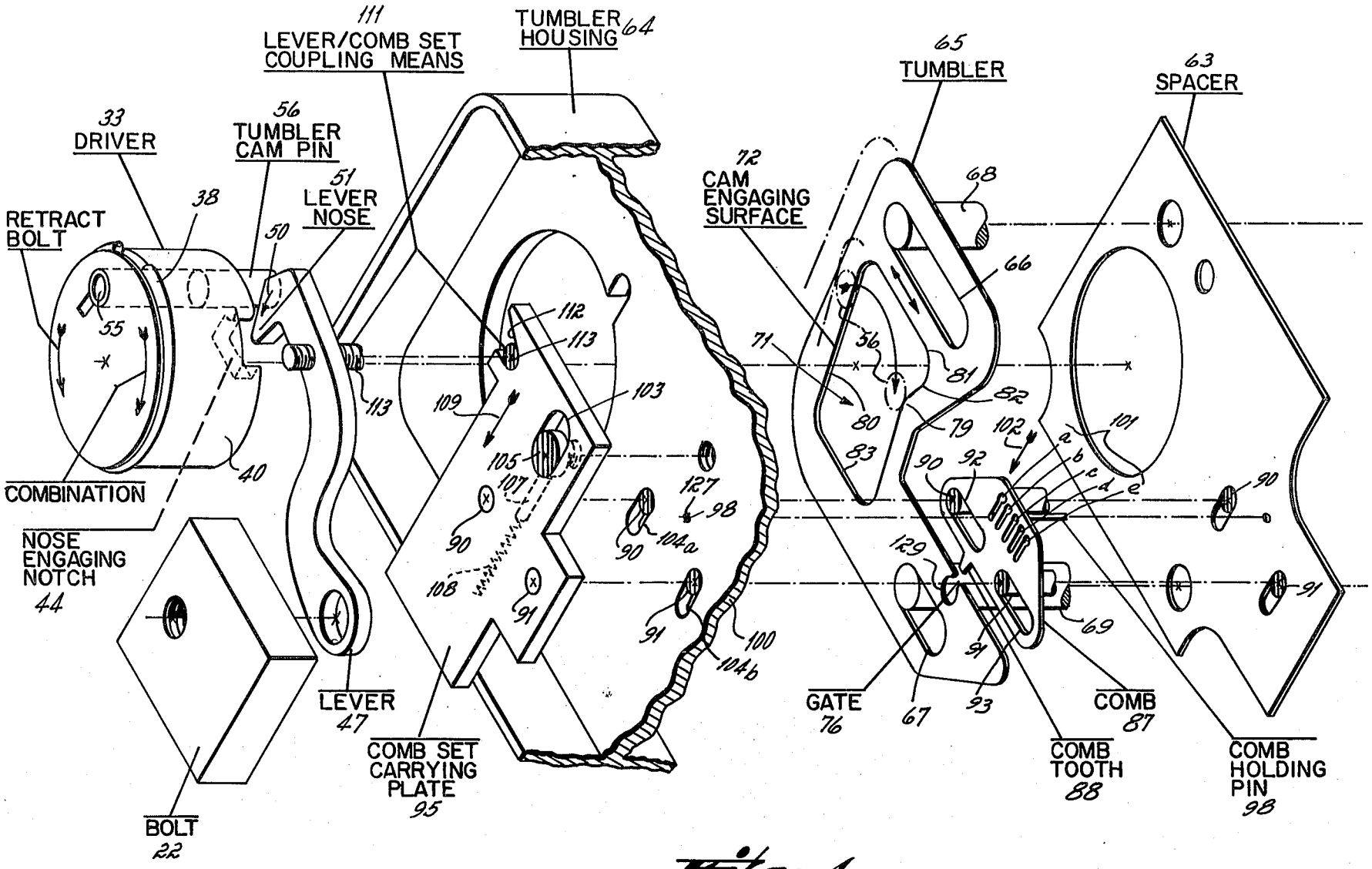
Figure 5:
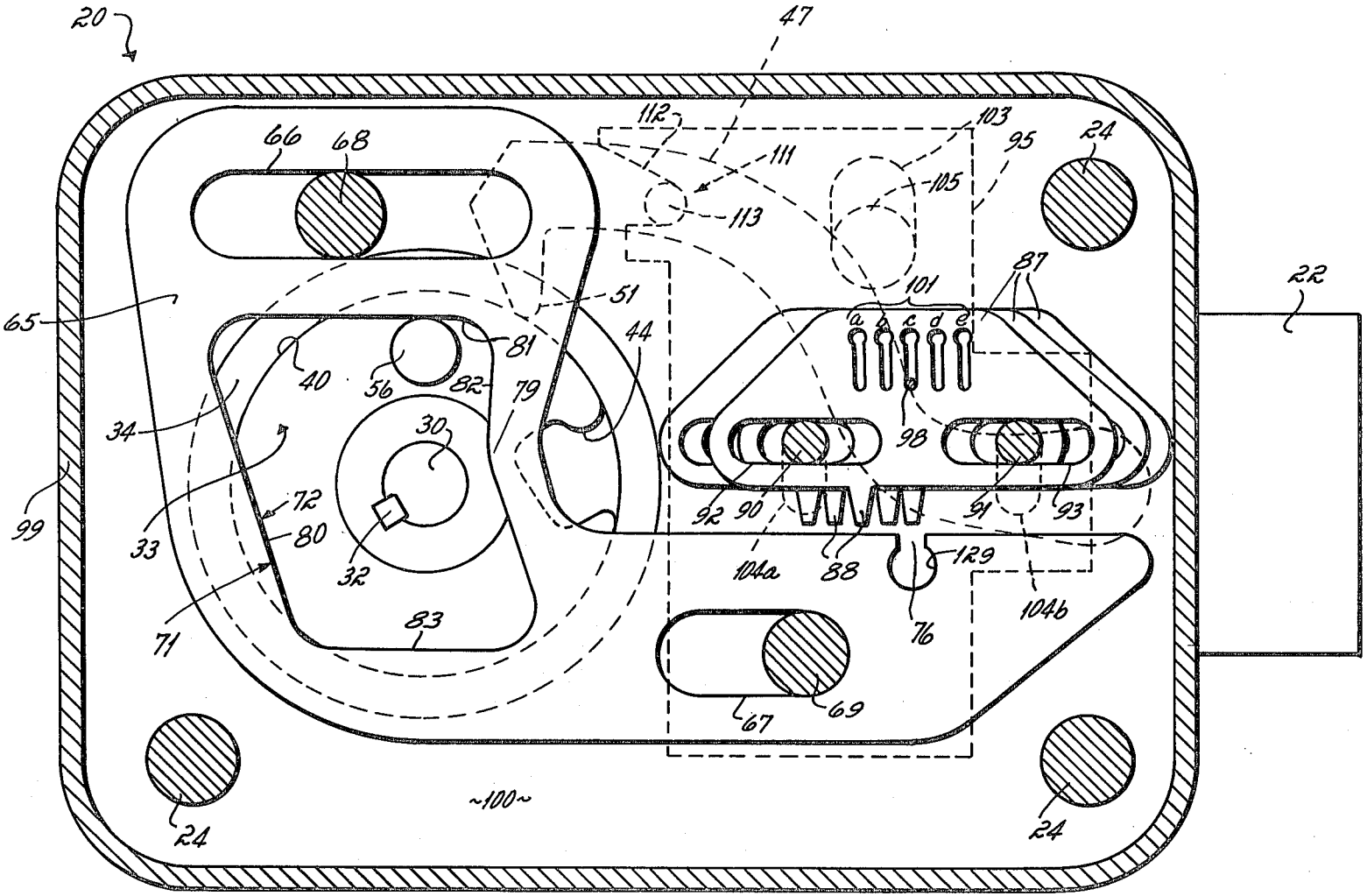
Figure 5A:
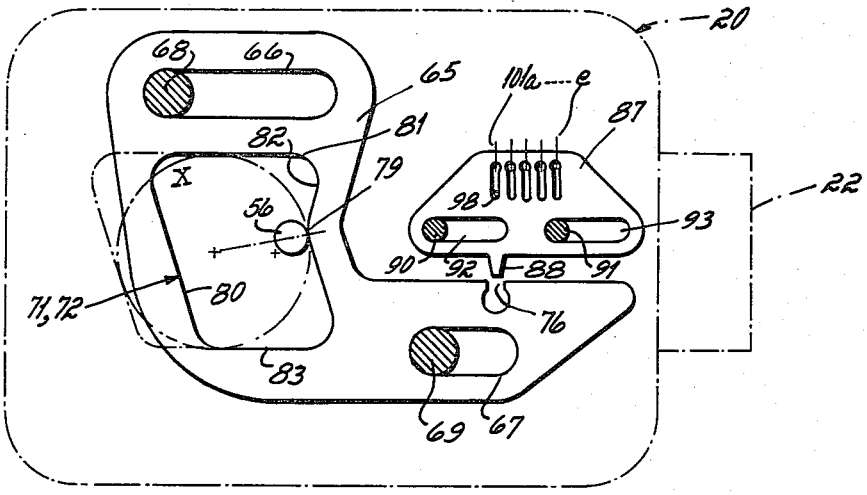
Figure 5B:
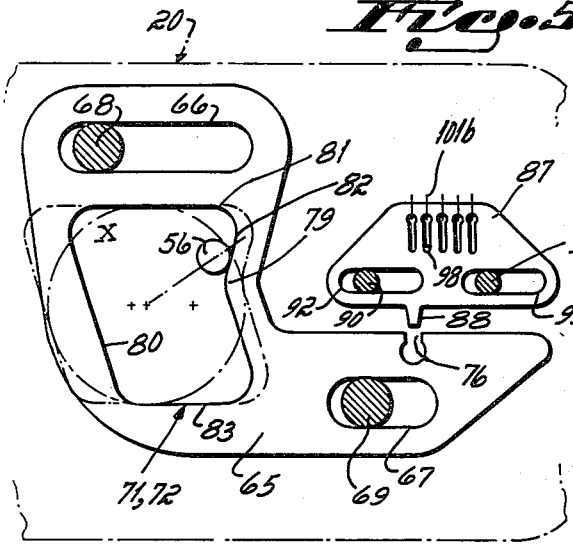
Figure 5C:
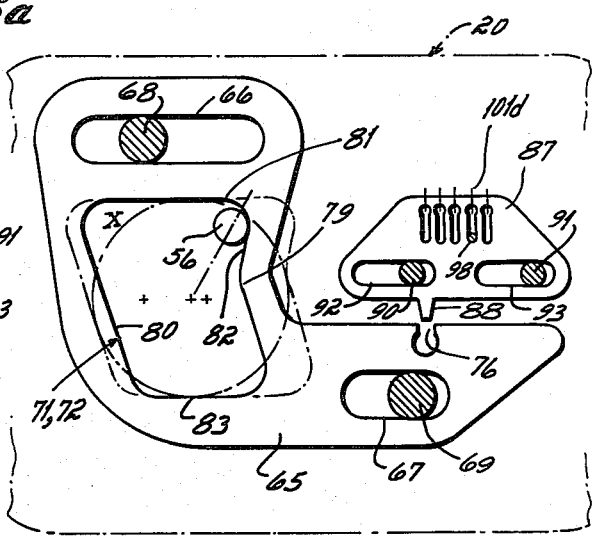
Figure 5D:
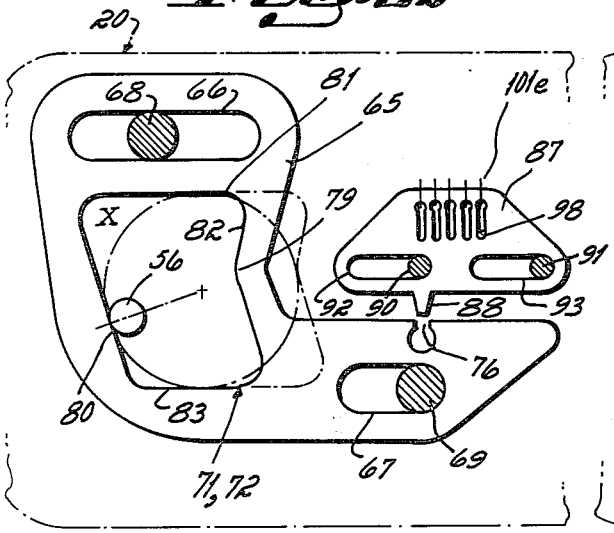
Figure 5E:
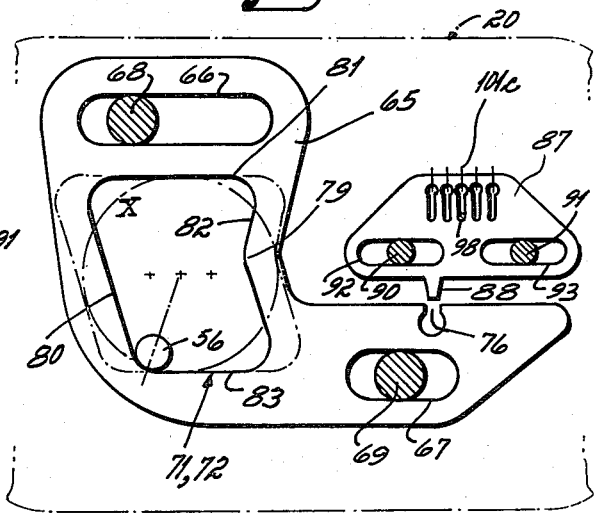
Figure 6:
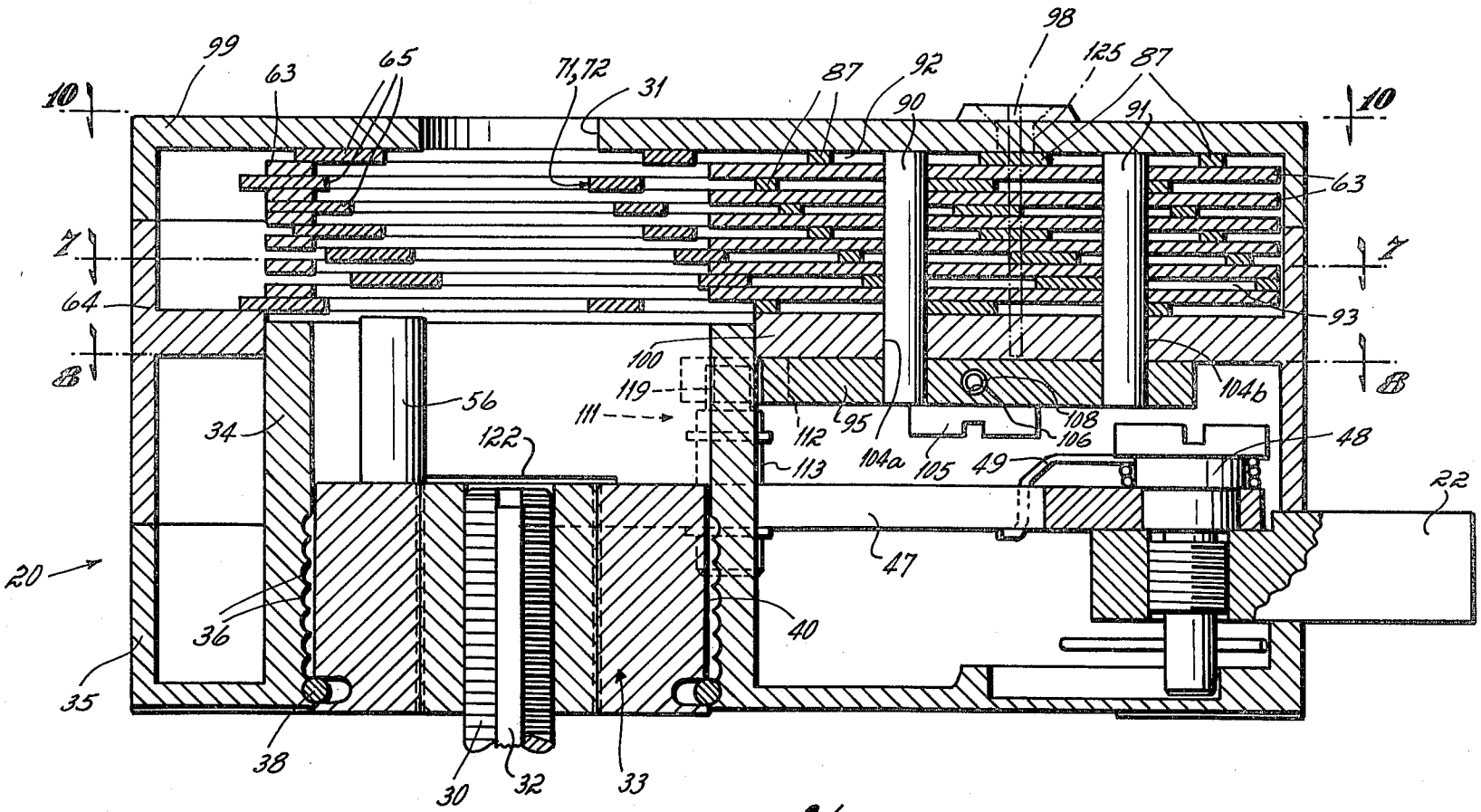
Figure 1:
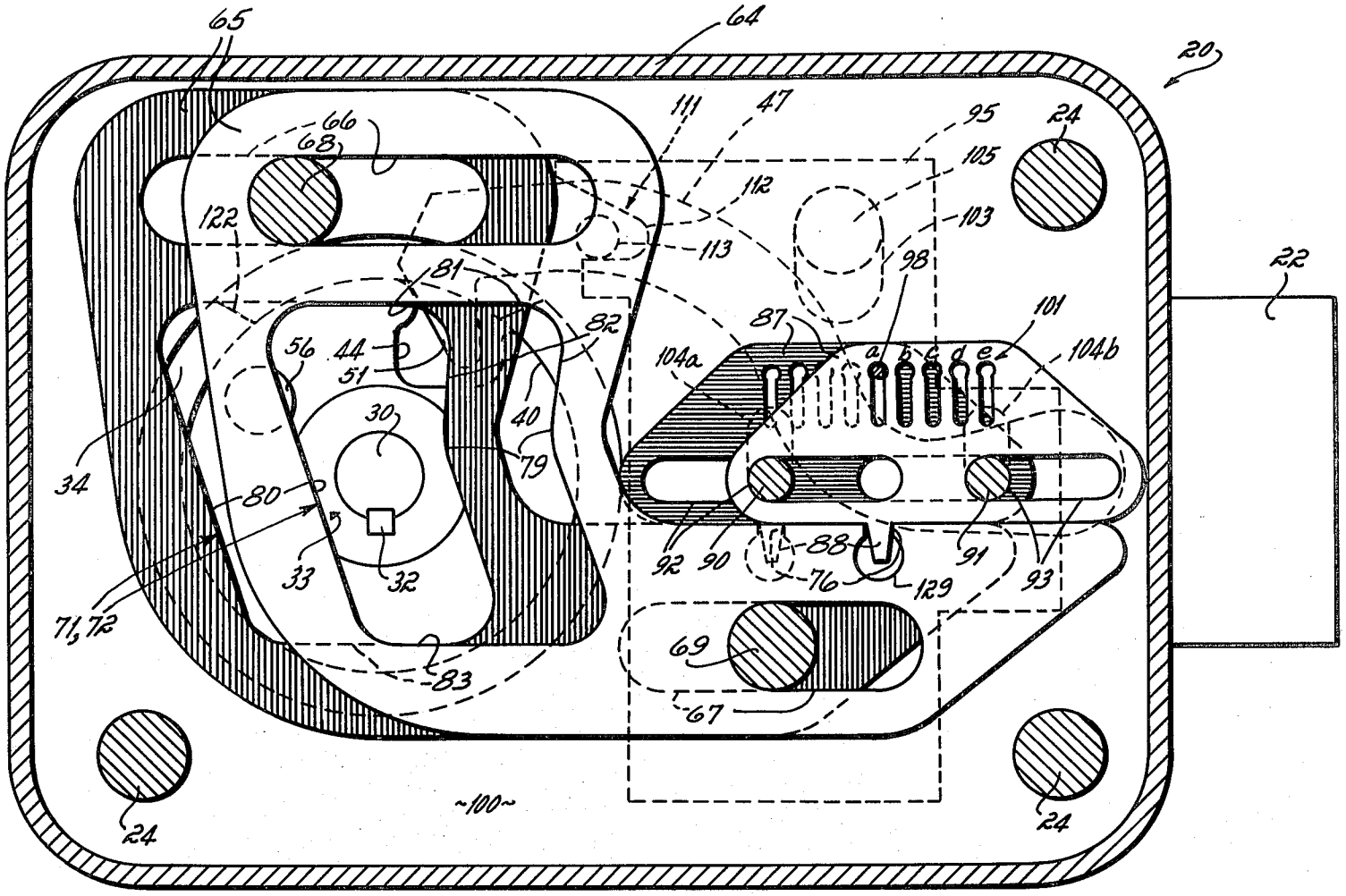
Figure 8:
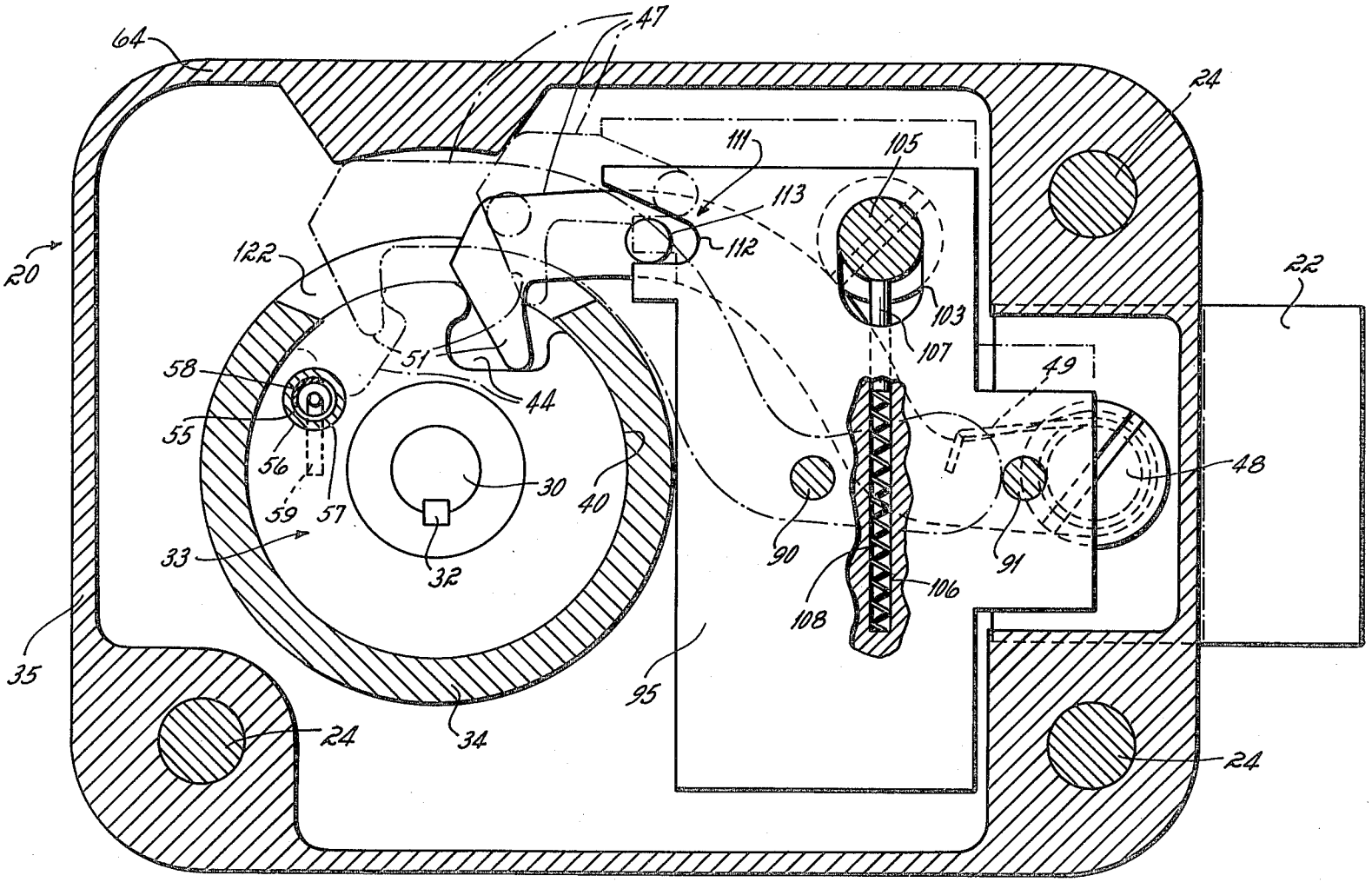

The invention can best be further described and explained by reference to the accompanying drawings, in which:

FIG. 1 is a front view of the dial of a lock in accordance with the preferred form of the invention, as mounted to a safe door, showing several principal components in dashed lines with the bolt in the extended position, FIG. 2 is a rear view of the lock shown in FIG. 1, the lock being inverted with respect to FIG. 1 to show how it can be mounted with its bolt in the righthand side, FIG. 3 is a horizontal section taken on line 3—3 of FIG. 1, showing the driver in the innermost axial position for starting to run the combination, FIG. 4 is an exploded and diagrammatic perspective of principal components of the lock, FIG. 5 is a vertical section taken on line 5—5 of FIG. 3, with the spacers omitted for the sake of clarity, FIGS. 5*a*–5*e* are simplified diagrammatic views similar to FIG. 5, showing how a single tumbler and comb are aligned at positions corresponding to the numbers 1 to 5 respectively on the lock dial (clockwise rotation), FIG. 6 is a horizontal section similar to FIG. 3 but shows the driver in its outermost axial position for retracting the bolt, FIG. 7 is a simplified vertical section taken on line 7—7 of FIG. 6, showing two tumblers and two combs engaged, just prior to retracting the bolt, FIG. 8 is a simplified vertical section taken on line 8—8 of FIG. 6, with the comb carrying plate in the position at which the combs engage the tumbler gates for bolt retraction, the dashed lines showing the lever in the bolt withdrawn position.

Figure 9:
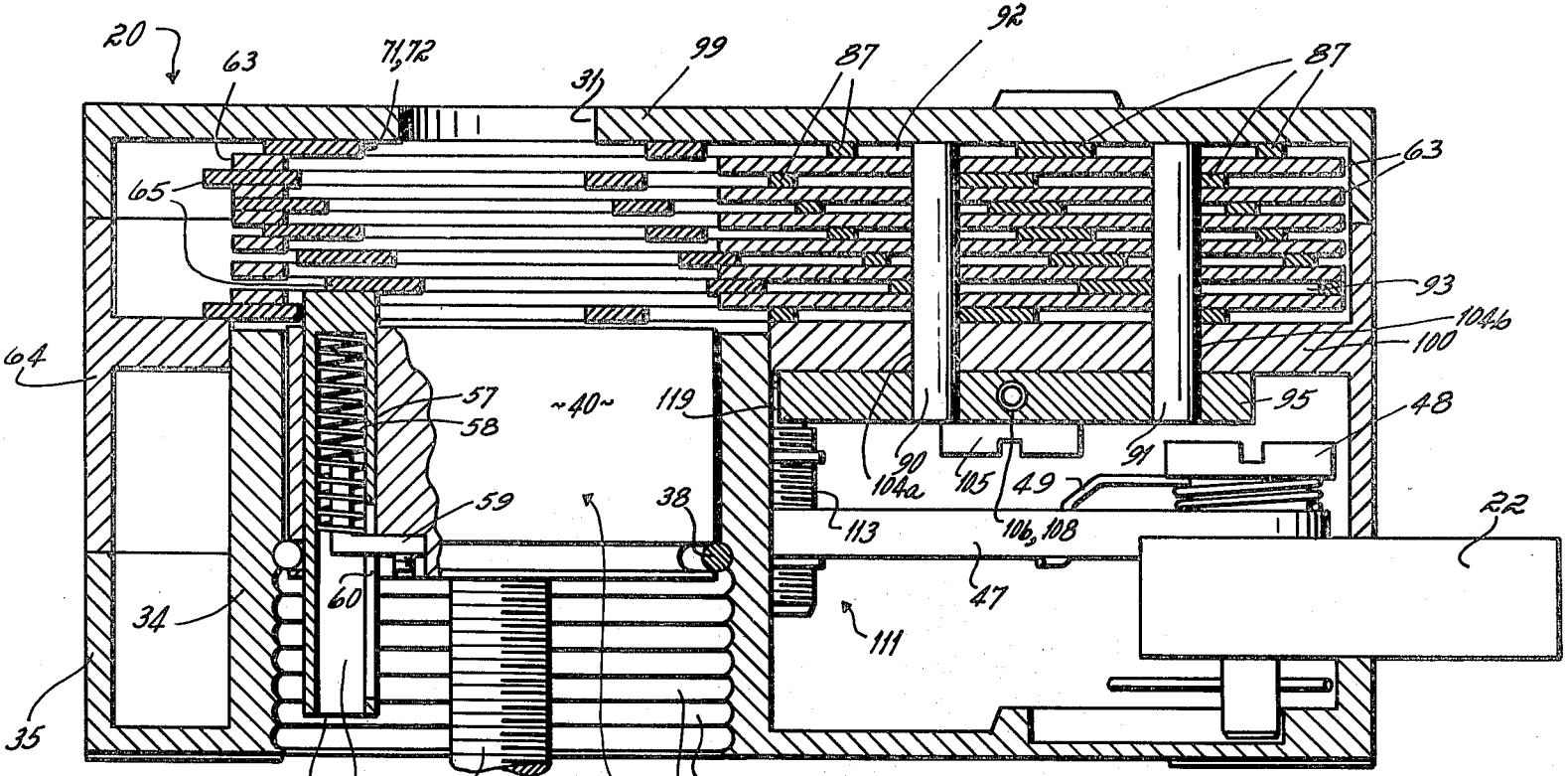
Figure 10:
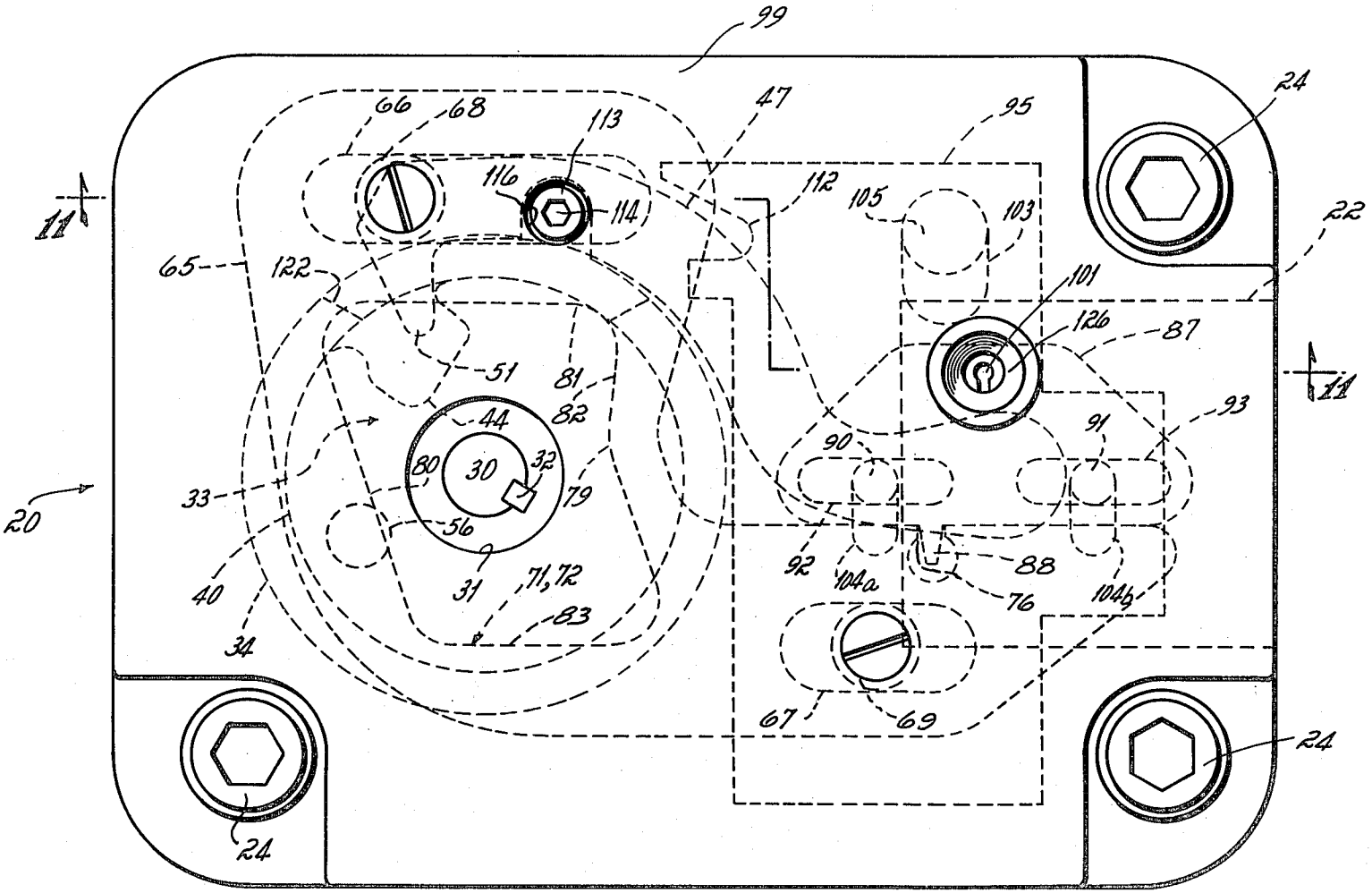
Figure 11:
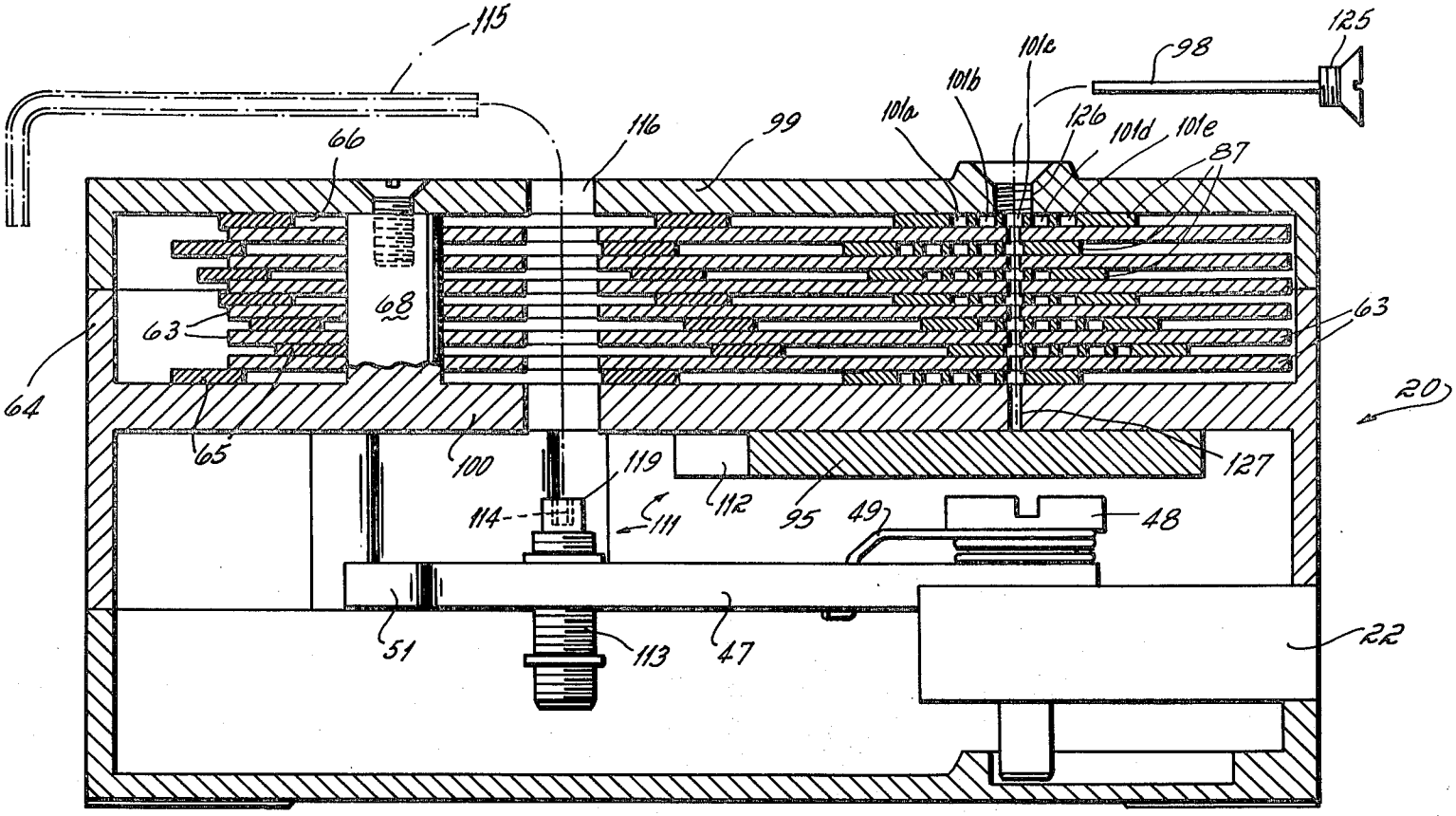
Figure 12:
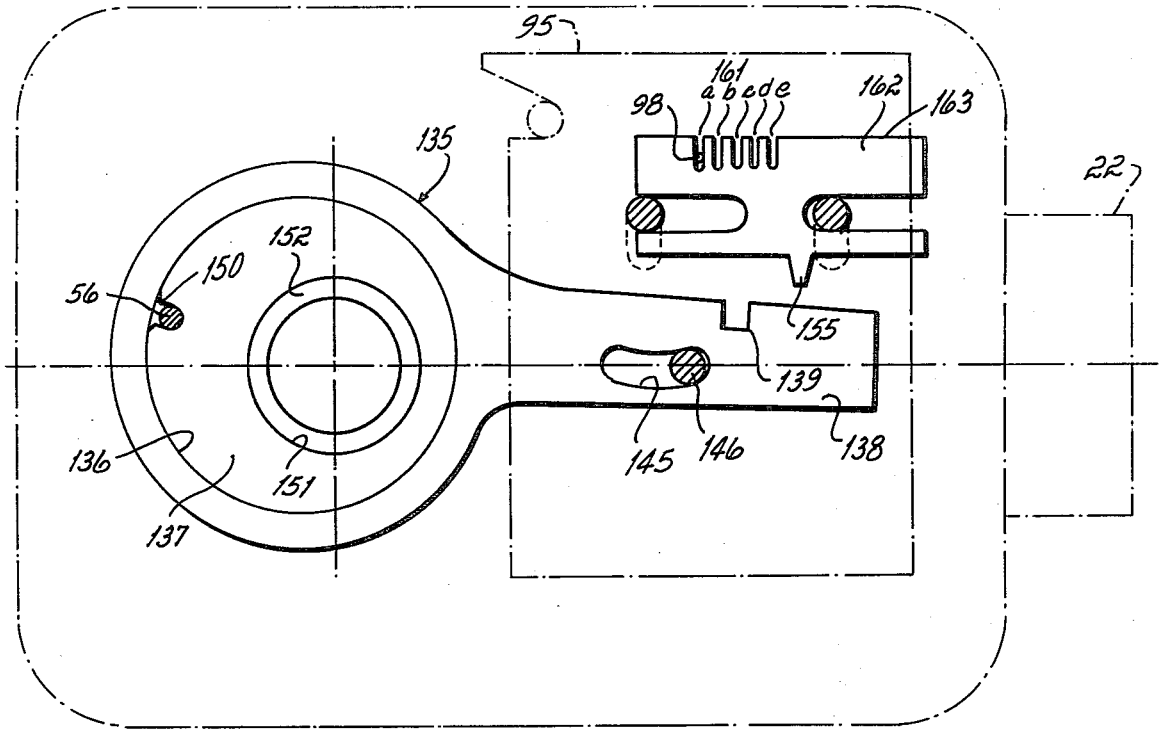
Figure 13:
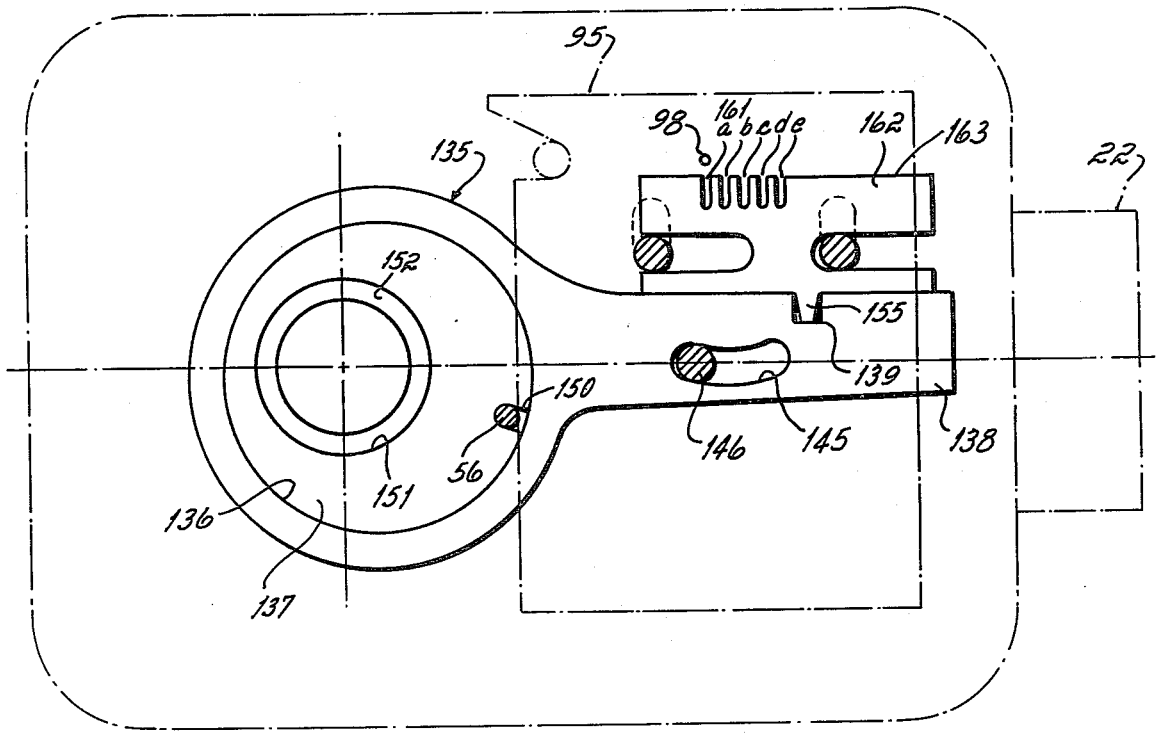

FIG. 9 is a horizontal section similar to FIG. 6 but shows how the tumbler cam pin yields axially if the driver is pushed in at a position at which the cam bears endwise against a tumbler, FIG. 10 is a rear elevation taken on line 10—10 of FIG. 6, with the cover in place and the comb positioning pin removed in preparation for changing the combination, FIG. 11 is a horizontal section taken on line 11—11 of FIG. 10, with the lever disengaged from the comb set and the comb positioning pin removed so that the combs can follow the tumblers for changing the combination, and FIGS. 12 and 13 are simplified vertical sections of a lock in accordance with a modified embodiment of the invention having a different form of tumbler-reciprocating cam and a different form of comb, FIG. 12 showing a tumbler in a disaligned position with respect to its comb, and FIG. 13 showing the comb tooth received in the tumbler gate prior to withdrawing the bolt.

In the preferred embodiment of the lock, the dial has five numbered rotational positions and eight axial positions for operating seven tumblers. It will become apparent that more or fewer rotational positions or tumblers may be used without departing from the principles of the invention. One advantage of the present lock is that it provides a large number of permutations with relatively few dial rotational positions, so that many dial rotary or axial positions are unnecessary. The seven tumblers and five rotary settings provide for $7^5$ or 16,807 different combinations. At a rate of operation of, say, 12 seconds to run each possible combination, approximately 56 hours of operation would be required to run them all. So long a period is more than adequate protection for many if not all ordinary applications.

In the drawings the case of the lock is designated generally by 20 and is shown in FIGS. 1–3 as mounted to a safe door 21, to which it is secured by bolts 24. The lock has a bolt 22 which projects through an opening in the side of the case and is received in a recess or striker 23 on the inside of the safe.

The lock is operated by a rotatable circular dial 25 (FIG. 1) which includes a knob 26 for turning it. The dial has an index point 27 which is alignable at five predetermined angular positions with numbers 1–5 marked on a fixed number disk or ring 28. (Alternatively, the index point can be presented on the fixed disk and the numbers on the dial). Note that the numbers 1–5 are not necessarily uniformly spaced circumferentially.

A threaded operating shaft 30 projects axially from dial 25 through an opening in the safe door and into lock case 20. A generally cylindrical driver 33 is threaded to the inner end of shaft 30, and is splined or keyed to it as at 32 (FIG. 6). The spline can be inserted into the shaft through an opening 31 in the cover of the case.

The assembly of dial 25, arbor 30 and driver 33 are axially shiftable with respect to lock case 20, for selectively disengaging tumblers as they are set. The driver is supported and guided in such axial movement within a cylindrical sleeve 34 formed on base portion 35 of case 20. A detent establishes eight discrete axial positions of the driver with respect to sleeve 34. Specifically, a series of eight annular grooves is formed on the inside of sleeve 34 in spaced axial positions. The driver is provided with a detent in the form of a circular spring 38 which is carried in a circular recess in the driver. Spring 38 exerts a radial outward force, like a piston ring, and it snaps into the particular groove 36 with which it is most closely aligned, thereby insuring that the driver centers in a preestablished axial position. These correspond to the seven axial positions at which the driver will disengage the respective tumblers, plus one additional position at which the driver is disengaged from all of the tumblers and will receive a lever nose.

The surface of the driver is generally cylindrical as designated at 40 in FIG. 4, to support the nose of the lever as will be described. The length of driver cylindrical surface 40, i.e., its dimension as measured in the direction parallel to the driver axis, corresponds to the axial dimension of the series of grooves 36 and to the thickness of the tumbler pack to be described. A lever nose-engaging notch 44 is provided at the inner end of the driver (i.e., the upper end as seen in FIG. 3.)

Bolt 22 is mounted for sliding movement in guides or ways not shown, formed in the base 35 of lock case 20, for movement between the extended or lock position shown in FIGS. 10 and 11. The bolt is moved between these positions by a lever 47 which can be operated by the driver (and dial) when the proper combination has been set. At one end the lever is connected to bolt 22 by a lever stud 48 (FIG. 3) which provides a pivotal connection between them. A coil spring 49 biases lever 47 in a direction toward the driver axis, as indicated by arrow 50 in FIG. 4. This tends to swing the lever nose or lug 51 toward the driver's surface 40.

In the preferred embodiment shown in FIGS. 1–11, a tumbler cam in the form of a pin 56 is mounted by the driver and projects parallel to but off-set from the driver axis. This cam 56 is engageable with cam surfaces presented by the respective tumblers to cam the tumblers in substantially linear motion when the driver is rotated. The cam itself is slidable lengthwise in a bore 57 in the driver, and has a stopped axial bore 55 in which a coil spring 58 is held captured by a spring retainer 59 that extends through a slot 60 in the side wall of the cam (see FIG. 9). Spring 58 biases cam 56 axially outwardly from the driver (toward lock back cover 99, see FIG. 9). Such biased outward movement of the cam from the driver may be arrested by engagement of the cam end with the face of a tumbler, as will be described.

Cam 56 cooperates with a series of tumblers, seven in the embodiment shown, to cam them in substantially linear or reciprocating movement in planes parallel to the plane of the bolt and perpendicular to the arbor axis. The individual tumblers 65 are separated by non-moving spacers 63 (FIGS. 3 and 4) and together these elements are mounted as a subassembly or pack carried by a tumbler housing 64. Each tumbler 65 is roughly of an "L" shape with a central cutout or aperture 71 at the junction of the legs. The edge 72 of this aperture 71 functions as a cam surface and is engaged in cammed relation by cam 56 as the cam is swung in a circular path by rotation of arbor 30.

Two parallel slots or guide tracks 66 and 67 are formed in the legs of each tumbler. Tumbler guide posts 68 and 69 secured to the tumbler housing pass through these slots 66 and 67 and in practical effect confine the tumbler to a linear path of motion parallel to the bolt motion. The spacers 63 are interleaved between the tumblers (FIG. 3). Posts 68 and 69 pass through holes in the spacers, which do not move with the tumblers.

An upwardly opening gate 76 is formed on each tumbler, on a leg thereof (FIGS. 4 and 5). (If desired the gates 76 may be formed at different positions in the tumblers, to increase confusion.) In effect, the combination corresponds to the positions at which the respective gates (and hence, tumblers) must be set so that they are in alignment with the combs.

As already noted, in the embodiment shown dial 25 has five numbered rotational positions. These correspond to five different linear positions of each tumbler. The five tumbler positions are shown in FIGS. **5*a*–5*e*, corresponding to dial settings at numbers 1–5 respectively. From these figures it can be seen that as the driver is rotated in a given direction (a clockwise direction is assumed as viewed from the rear, in FIGS. 5*a–e*), the cam 56 does not at all times engage cam surface 72**. The tumblers are not biased toward the cam and in certain rotational arcs the cam is spaced from the cam surface of one or more tumblers. During such disengagement the tumbler will not shift, even though the cam is rotating.

In FIG. **5*a* tumbler 65 is shown in its "rightmost" cammed position, which (for the dial number positions shown in FIG. 1) corresponds to a dial setting at 1**. The leftmost tumbler position is established when the cam is at the rotational position shown in FIG. 5*d* (with reference to the dial number position shown in FIG. 1, this corresponds to a setting at 4, rather than at 5 as might be expected).

In the "five-number" embodiment shown, tumbler cam surface 72, defined by the aperture 71 in the tumbler, approximately corresponds in shape to a capital letter B, with an upper lobe 82, a lower lobe 83, a diagonally slanting left side 80, and a lift 79 between the upper and lower lobes. (It will be apparent that other cam shapes may be generated to establish more or fewer discrete gate positions.) The movement of the tumbler in response to a complete rotation of cam 56, assuming that the cam is rotated in a clockwise direction from its leftmost position, is shown in the sequence of FIGS. 5*d*, 5*c*, 5*b*, 5*a* and 5*e*.

Following the cam as it is rotated in clockwise direction from the leftmost (or number 4) position in FIG. 5*d*, the cam will disengage the left side wall 80 of cam surface 72, and will swing within the aperture without engaging the tumbler. The cam will reengage cam track 72 near the upper righthand corner 81 of the aperture and, at the position shown in FIG. 5*c* has shifted the tumbler a certain distance to the right, to the next number position which corresponds to dial setting 3. Further clockwise rotation of the cam to the position shown in FIG. 5*b*, in which it tracks on the upper lobe 82 corresponds to dial numbered position 2. Continuing, at the cam position shown in FIG. 5*a* the cam has just reached the end of upper lobe 82 at lift 79, establishing the rightmost position of the tumbler, corresponding to number 1. From this point the cam (rotated clockwise) disengages the cam track and swings without imparting movement to the tumbler, until it re-engages the cam track near its lower lefthand corner, before shifting the tumbler to a position corresponding to dial number 5.

The foregoing tumbler settings have been described with the assumption that the driver is constantly being rotated in the clockwise direction. It can be seen from a study of FIGS. 5*a–e* that if the driver is rotated in the opposite direction, the cam will engage and disengage the cam track at other positions and the dial settings that then correspond to the tumbler positions shown, may differ. It is thus necessary, in running a given combination, that the driver always be rotated in a predetermined direction of rotation.

A series of combs, each designated by 87, will interfit with the gates 76 of the respective tumblers 65 if but only if the tumblers have all been set at positions corresponding to the combination. Each comb is generally trapezoidal in shape and has a projecting tooth 88 which is receivable in the gate 76 of the respective tumbler. The several combs are separated by and slidable between the spacers 63 (FIGS. 3 and 4) and are supported on two posts 90 and 91 that pass through horizontal slots 92 and 93 respectively in each comb (see FIG. 5). Posts 90 and 91 project from a comb carrying plate 95. This mounting arrangement constrains each comb to linear motion with respect to plate 95, in a direction parallel to the direction of tumbler and bolt movement. The length of slots 92 and 93 is such as to permit the combs to be shifted between a leftmost position in which the comb tooth 88 is in alignment with the gate 76 of a tumbler at the position shown in FIG. 5*d*, and a rightmost position at which the comb tooth is in alignment with the gate of a tumbler in the rightmost position shown in FIG. 5*a*. The assembly of combs and the carrying plate 95 is collectively referred to as the "comb set".

Each comb also presents a series of vertically extending slots 101*a–e* (FIG. 5), corresponding in number to the number of dial positions (five in the example shown). A removable comb holding pin 98 projects from the back cover 99 of the lock case forwardly into a bore 127 in cross-partition 100 of tumbler housing 64, passing through one of the slots 101 in each comb. The slots 101 are so positioned that, engaged in them, pin 98 holds the comb in the positions at which the comb tooth will align with the respective tumbler gate in its various positions corresponding to dial number positions.

The comb set, including plate 95, is shiftable as an entity in the direction toward and away from the tumblers, perpendicular to the direction of tumbler shifting movement (vertically, as shown by arrow 102 in FIG. 4). It is guided in this motion by a post 105 which slides in a slot 103, and the comb posts 90, 91 which pass through two slots 104*a* and *b* (FIGS. 4 and 10). Post 105 is threaded into cross partition 100 and its slot 103 is formed in plate 95; posts 90 and 91 are secured to plate 95 and their slots 104*a* and *b* are presented in partition 100. Thus the combs are individually slidable, with respect to comb carrying plate 95, in the direction parallel to the tumbler movement, and the comb set as a unit is slidable perpendicularly toward and away from the gates of the tumblers. The first (parallel) type of movement is involved in changing the combination in the lock, as will be described; and the second (perpendicular) type of movement occurs when a combination has been run and the comb set is moved toward the tumbler gates preparatory to attempting to withdraw the bolt.

Comb carrying plate 95 is biased toward the tumblers. For this purpose the plate presents a bore 106 (FIGS. 8 and 9) in which a plunger or piston 107 is slidably received. A compression spring 108 in bore 106 urges plunger 107 upwardly, against the side of post 105 (FIG. 8). Spring 108 exerts a reaction force on plate 95 which tends to move the comb set downwardly, as shown by arrow 109 in FIG. 4 toward the tumblers.

The comb set is separate from lever 47, and the lever can move independently of the combs. Coupling means designated generally at 111 in FIG. 8 reflect or apply only certain motions from the lever to the comb set. This coupling means includes a notch or cut-out 112 formed in the left side of plate 95, as seen in FIGS. 4 and 5, which releasably receives a post 113 that projects from lever 47. Post 113 is threaded into the lever so that it can be moved between a comb set-engaging position (FIGS. 3 and 9) and a disengage position (FIG. 11). Post 113 is socketed at one end, as shown in FIG. 11 at 114, to receive an Allen wrench 115 which can be inserted into the socket through an opening 116 in lock cover 99 and past the tumblers and spacers. When post 113 is in the comb engaging position, its tip 119 lies in the same plane as comb carrying plate 95 so that it can engage in notch 112. The comb set is thereby coupled to the lever to respond to lever movement in the perpendicular direction toward and away from the tumblers, while the open (left) side of notch 112 decouples the lever when it is moved to the left, as seen in FIG. 8, in withdrawing the bolt when the combination has been set.

Lever nose 51 projects through an opening 122 in sleeve 34 and rides on driver cylindrical surface 40 during the tumbler setting procedure, i.e., until the driver has been pulled to the axially outermost position shown in FIG. 6. At all axial positions of the driver save that position, the engagement of lever nose 51 on driver surface 40 holds the lever in the "raised" position shown in dotted lines in FIG. 5. In this lever position comb coupling post 113, engaged in notch 112, holds the comb set spaced away from the tumblers. This prevents any "feel" or contact between a comb tooth 88 and the sides of a gate which might be used to determine a position of gate/tooth alignment.

Running the Combination

In running the combination dial 25 must always be turned in the same direction of rotation (in the embodiment described, always counterclockwise as viewed from the front of the lock, FIG. 1). This insures that cam 56 will always engage each tumbler cam track 72 at the same point at each dial number setting. The dial need not be turned any prescribed number of turns before it is stopped at a given number position; the number of turns is of no significance.

The combination is run by starting with the dial and driver in the axially innermost position as shown in FIG. 3. As the dial is rotated, cam 56 cams the tumblers in linear or back and forth motion, changing the positions of the tumbler gates in relation to the respective comb teeth. At this innermost dial position, the cam operates all the tumblers; after the first (innermost) tumbler has been set at desired position the dial is pulled incrementally outward one "step" so that detent spring 38 clicks out of the first groove 36 into the next. The dial is stepped axially after each succeeding tumbler is set, so that the tumblers are sequentially "dropped off" or disengaged as the combination is run. While the tumblers are being set, the driver holds the lever in the raised position, and post 113 holds the comb set away from the gates so that no "feel" of gate position is afforded.

When all the tumblers have been set the dial is shifted axially one more time, to the outermost (FIG. 6) position. This brings driver notch 44 into the plane of the lever nose 51. The dial is rotated in the opposite direction to a predetermined position at which the notch is aligned with the nose. The lever, no longer supported by cylindrical surface 44, is swung by spring 49 counterclockwise around lever stud 48, see FIG. 8, toward engaging the notch. As the lever swings, post 113 no longer restrains comb carrying plate 95, and spring 108 shifts the plate toward the gates, carrying the combs with it on posts 90 and 91.

For any given combination both the gates and the combs are usually well scrambled. That is, the gates are not all in line with one another, nor are the teeth. This "dual scrambling" feature—both gates and teeth—provides greatly increased resistance to surreptitious attack, in comparison to locks having only a straight (unscrambled) fence bar.

If one or more of the gates is misaligned with respect to the corresponding tooth, then that tooth will be arrested by the tumbler edge and will block further movement of the combs. This arrests movement of comb carrying plate 95 and that, in turn, stops the swinging movement of the lever nose before it has entered the driver notch, and the bolt cannot be withdrawn.

If the tumblers have all been properly set so that their gates are aligned with the respective comb teeth, then the teeth will interengage in the gates, as illustrated in FIG. 10. Lever nose 51 will also drop into driver notch 44 as shown in FIG. 8. The bolt can then be withdrawn by turning the dial clockwise (as viewed in FIG. 1), so as to draw the lever and the bolt to the left. As this movement occurs, lever-comb coupling post 113 slides out of the open side (the left side as seen in FIG. 8) of comb plate notch 112. Thus the bolt-withdrawing movement of the lever is not transmitted to the combs, and they remain stationary while interengaged with the tumblers as the lever withdraws the bolt.

The combination is thus determined by the comb positions, and this is in turn established by the particular comb slots 101*a–e* through which comb holding pin 98 passes. FIGS. 5*a*–5*e* show the comb positions corresponding to dial number settings of 1 through 5 respectively. In the embodiment illustrated, the correspondence is as follows:

| Dial Number | Comb Slot |
|---|---|
| 1 | 101a |
| 2 | 101b |
| 3 | 101d |
| 4 | 101e |
| 5 | 101c |

It will be apparent that this correspondence is itself established by the shape of cam track 72, and that other cam shapes for other relationships can be developed.

The sliding engagement of the comb pin 98 in the slots 101*a–e* maintains the relative lateral or left to right positions of the combs as comb carrying plate 95 is moved toward and away from the gates.

Changing the Combination

The comb pin 98 can be disengaged from the combs for changing the combination. This is shown in FIG. 11. For such removability pin 98 projects from a machine screw 125 which threads into an opening 126 in lock cover 99. When the pin has been removed from the combs (which can be done only when the safe door has already been opened) the combs are no longer pinned in fixed lateral positions, and they are free to be shifted relative to one another.

In order to set a desired new combination into the lock, the existing combination must first be run and the bolt withdrawn. This engages each comb tooth in its respective tumbler gate, as shown in FIG. 10, and decouples the lever from comb carrying plate 95.

Comb holding pin 98 is then removed so that the combs are no longer held by it against lateral movement. Allen wrench 115 is inserted into the socket 114 of lever post 113 and the post is screwed into the lever (FIG. 11) so that its tip 119 is removed from the plane in which it would engage notch 112. (Post 113 aligns with wrench opening 116 in cover 99 only when the bolt has been withdrawn, as a safety precaution.) With this accomplished, the bolt is then thrown again, but the lever is now uncoupled from the comb set and thus does not lift the combs out of the gates. The combs remain engaged with the respective tumblers. The new combination is run and, as the tumblers are shifted linearly, the gates transmit such shifting motion to the comb teeth which they engage and thereby position the combs accordingly. When the new combination has been set, the bolt is again withdrawn, pin 98 is reinserted and secured, passing through those slots 101*a–e* of the combs which are now in alignment with it. Post 113 is threaded to its comb plate engaging position. When the bolt is re-extended, the lever will again lift the comb set from the tumblers. When the bolt has been thrown, the tumblers can be scrambled simply by pushing in the dial and rotating it once.

When the driver is pushed inwardly from its outermost position, cam 56 may or may not be aligned with the apertures 71 in the tumblers, depending upon their positions. It should be noted that the "B" configuration shown for the aperture provides one dial position at which the cam can pass into the aperture 71 of all the tumblers when it is pushed in from its outermost position, regardless of tumbler position. This can be seen in FIGS. *5a–e:* regardless of tumbler position, if cam 56 is in the upper left position denoted by "X" in each figure, it will project into the aperture. Thus the dial should be turned to this position for "push in" movement. (However, the lock is not damaged if the dial is pushed in another rotational position than at X. The inner end face of cam 56 may bear against the face of the outermost tumbler without harm, because cam 56 is spring loaded from the driver so that it can yield axially if this occurs. As the driver is rotated, the cam end face will then skid across the face of the tumbler until it pops into aperture 71. FIG. 9 illustrates this anit-abuse feature).

From what has been said, those skilled in the art will understand that tumbler cam track shapes other than the "slanted B" shape shown can be used to produce reciprocating tumbler motion from rotary cam motion. For example, if the track were in the shape of a vertical slot in which cam 56 rides, then sinusoidal back and forth motion would result. That particular cam shape shown in the embodiment of FIGS. 1–11 is preferred because its slanted sides give radiographically "fuzzy" images, making identification of position more difficult. (A vertical slot cam track, for example, would produce a sharp line image on radiographing from the top of the lock, which would render it more analyzable). Moreover, the slanted B shape shown also provides a "constantly open" area (as at X in FIG. *5a*) wherein the cam will always pass into the aperture at a given dial position as the driver is shifted axially inwardly, without striking the tumbler face.

In the preferred embodiment of the invention described above, the tumbler cam is in the form of an off-center pin which projects endwise from the driver and engages the tumbler apertures intermittently as the driver is rotated, thereby to shift the tumblers in reciprocating motion. FIGS. 12 and 13 illustrate an alternative embodiment of the invention wherein the tumbler cam is a disk which is journaled for eccentric rotation by the driver pin. The disk turns within a circular aperture in the respective tumbler, and its eccentric rotation cams the tumbler in reciprocating movement.

More specifically, in the modified embodiment each separate tumbler 135 is provided with a "built-in" eccentric rotary cam 137 which is engageable and rotatable by the driver pin 56. In this case the pin 56 does not cam the tumblers directly; it rotates the cams 137 (of which only one is shown) which in turn cam the respective tumblers. Each disk cam 137 has an off-center aperture 151 by which the cam is journaled for rotation on a fixed cylindrical sleeve 152 which projects forwardly from the lock cover. A notch 150 in the cam receives the driver pin 56.

Each tumbler 135 has a circular internal aperture 136 in which the respective circular cam 137 is journaled for rotation. The tumbler has an elongated arm 138 in which a gate 139 is defined. A fixed post 146 extends through a bean-shaped slot 145 in arm 138, to guide the movement of the arm. The structure shown in FIGS. 12 and 13 thus translates rotary movement of the driver into reciprocating movement of the gate 139 with respect to the cooperating comb tooth 155. (The motion is similar to that of the connecting rod in a reciprocating engine).

It can be seen that in this embodiment the tumbler is cammed at all times during rotation of the driver; unlike the preferred embodiment there is no intermittent camming engagement as the cam turns. The driver pin 56 is sequentially engageable or releasable from the tumbler cams 137 as the driver is shifted axially, as in the first embodiment, and the other structure may be similar to that already described.

A trapezoidal shape (FIG. 5) is preferred for the combs, because it produces radiographically fuzzy images that hamper analysis, but other shapes can be used. FIGS. 12 and 13 also show a modified form of comb, which can be used in place of that previously described. In this embodiment the comb tooth slots, designated at 161*a–e,* extend to the upper edge 163 of the comb 162. As in the preferred embodiment, the comb holding pin 98 is engaged in one of the slots 161*a* (FIG. 12) so that the comb can move in the vertical direction without loss of its relative position in the horizontal direction. Here, however, when the comb tooth 155 is received in a tumbler gate 139 (FIG. 13) the comb is clear of pin 98 so that the combination can be changed without removing the pin 98 from the case. The comb mounting means as well as the other elements of the lock in this embodiment may correspond to those already described in the first embodiment.

Use of radiographically transparent materials also hampers detection, as is known in the art. If desired, the lock may be provided with "false" tumblers and/or combs, for example, by shaping the spacers to confuse radiographs, or by including inactive tumblers or combs in the pack. In this connection it will be noted that the tumbler gates 76 are preferably defined as a relatively narrow entrance to a circular opening 129 (see FIG. 5), which makes more difficult the radiographing of the actual gate position. It is also noted that fusible pins, etc., may be incorporated as known in the art.

Having described the invention, what is claimed is:

1. In a direct dial combination lock of the type wherein a driver is rotated to position tumblers, the driver is sequentially indexed axially to disengage the respective tumblers after such positioning, and a lever is movable into connection with the driver for operating a bolt after the tumblers are properly positioned, the improvement comprising, means mounting said tumblers for reciprocating movement, a rotary cam operated by the driver and engageable within each tumbler to cam the tumbler back and forth in said reciprocating movement as the driver is rotated, a set of combs respectively cooperable with gates presented by the tumblers, the respective combs being receivable in the gates when the corresponding tumblers have been moved to positions of alignment with respect to the combs, and coupling means between the lever and the comb set for holding the comb set away from the tumblers until the lever is moved toward connection with the driver for withdrawing the bolt.

2. The lock of claim 1 wherein said tumblers are unbiased with respect to said cam.

3. The lock of claim 1 wherein each tumbler has an internal aperture the periphery of which comprises a cam surface, said cam being engageable with said cam surface within said aperture.

4. The lock of claim 3 wherein said cam comprises a pin projecting from the driver parallel to but offset from the axis of driver rotation.

5. The lock of claim 4 wherein said pin engages the periphery of said internal aperture in the tumbler, to cam said tumbler in said reciprocating movement.

6. The lock of claim 5 wherein there is lost motion between the pin and the tumblers as the driver is rotated, the tumblers being unbiased with respect to the pin.

7. The lock of claim 6 wherein said aperture has the shape of a slanted letter "B".

8. The lock of claim 1 wherein the comb set is mounted for movement in a direction perpendicular to the reciprocating tumbler movement.

9. The lock of claim 1 wherein said combs are mounted as a set on comb mounting means, the combs being mounted for sliding movement relative to the comb mounting means, in the direction parallel to the tumbler movement.

10. The lock of claim 9 wherein said comb mounting means is biased toward said tumblers by a spring.

11. The lock of claim 10 wherein said comb mounting means is restrained from being moved by said spring toward said tumblers, by releasable engagement with said lever.

12. The lock of claim 11 wherein said combs are held in relative position on said comb mounting means by a pin engaged in holes in the respective combs.

13. The lock of claim 12 wherein each comb presents a series of parallel slots through which said pin can be engaged, to establish different combinations.

14. The lock of claim 13 wherein said pin slides in said slots as said comb set is moved toward said tumblers.

15. In a direct dial combination lock of the type wherein a driver is rotated to position tumblers, the driver is sequentially shifted axially to disengage it from the respective tumblers after such positioning, and a lever is movable into connection with the driver for operating a bolt after the tumblers are properly positioned, the improvement wherein said tumblers are mounted for linear movement parallel to the bolt movement, each tumbler presents a cam surface which is engaged by a cam on the driver to convert rotary motion of the driver into such linear movement of the tumbler, a set of combs is cooperable with gates presented by the tumblers, the comb set is mounted for movement in a direction perpendicular to the direction of linear movement of the tumblers, the combs of the set being receivable in the gates when the respective tumblers have been moved to positions of alignment with respect to the combs, and coupling means is provided between the lever and the comb set holding the combs away from the tumbler gates until the lever moves toward connection with the driver for withdrawing the bolt.

16. The lock of claim 15 wherein said cam surface is presented by a central aperture in the respective tumbler, and said cam is defined by an off-center pin on said driver.

17. The lock of claim 15 wherein said cam surface is formed as an aperture within the tumbler, said aperture having the shape shown in FIG. 5, the cam intermittently engaging the edge of the aperture to cam the tumbler.

18. The lock of claim 15 where the coupling means between the lever and the comb set is releasable to release the lever from the comb set when the driver is operating the bolt.

19. The lock of claim 15 wherein said cam projects from an end of the driver, into apertures presented by the tumblers.

20. The lock of claim 15 wherein the tumblers are mounted for such sliding movement on pins in a lock case, the pins passing through slot tracks formed in the tumblers.

21. The lock of claim 15 wherein detent stops are provided to position the driver axially with respect to the tumblers.

22. The lock of claim 21 wherein the lock includes a case presenting a sleeve which journals the driver for rotation, said detent stops comprising a series of grooves in said sleeve, and a spring clip extending circumferentially around said driver which snaps into the respective grooves as the driver is shifted axially.

23. The lock of claim 22 wherein the lever has a nose which projects through an aperture in said sleeve and rides on a cylindrical surface of said driver, said driver presenting a notch which receives the lever nose at a predetermined axial position of the driver, if said gates are aligned with said combs to establish the connection for operating said bolt.

24. In a direct dial combination lock, a rotatable driver, a series of reciprocable tumblers, each tumbler presenting an aperture, the edge of which comprises a cam track, a cam in said aperture and operated by the driver against said cam track to reciprocate said tumbler back and forth as said driver is rotated, and axial indexing means for disengaging the driver from the tumbler.

25. The lock of claim 24 wherein said tumbler presents a gate, said gate opening in a direction perpendicular to the direction of tumbler linear movement.

* * * * *